United States Patent [19]

Schwörer

[11] Patent Number: 5,029,803

[45] Date of Patent: Jul. 9, 1991

[54] DEVICE FOR ADAPTING A FORMWORK ELEMENT TO GIVEN RADII OF A CIRCULAR FORMWORK

[75] Inventor: Artur Schwörer, Senden, Fed. Rep. of Germany

[73] Assignee: Peri GmbH, Fed. Rep. of Germany

[21] Appl. No.: 461,392

[22] Filed: Jan. 5, 1990

[51] Int. Cl.[5] ..... E04G 11/12; E04G 17/06

[52] U.S. Cl. ..... 249/17; 249/20; 249/44; 249/47; 249/153; 249/179; 249/181; 249/219.1

[58] Field of Search ..... 249/191, 192, 193, 44, 249/47, 17, 19, 20, 40, 45, 10, 153, 179, 181, 219.1, 219.2

[56] References Cited

U.S. PATENT DOCUMENTS

| | | | |
|---|---|---|---|
| 4,033,544 | 7/1977 | Johnston | 249/40 |
| 4,081,227 | 3/1978 | Bohmer et al. | 249/20 |
| 4,619,433 | 10/1986 | Maier | 249/17 |
| 4,729,541 | 3/1988 | Maier | 249/194 |
| 4,811,927 | 3/1989 | Slonimsky et al. | 249/191 |
| 4,856,252 | 8/1989 | Cornell | 249/219.1 |

*Primary Examiner*—Jay H. Woo
*Assistant Examiner*—Khanh P. Nguyen
*Attorney, Agent, or Firm*—Walter A. Hackler

[57] ABSTRACT

The present invention provides for a device for adapting a formwork element, including a formwork lining and at least two formwork beams, to a given curvature of circular framework. A device includes a web engaging a space between two formwork beams and a cross-piece fixed to the web and equipped with two parallel, spaced plates which project laterally beyond the web and overlap the formwork beams in an installed position. Projecting portions are provided with mounting lugs in which a plurality of the lugs have at least one projecting portion and the lugs are arranged in two planes disposed at different spacings relative to the web.

10 Claims, 4 Drawing Sheets

DEVICE FOR ADAPTING A FORMWORK ELEMENT TO GIVEN RADII OF A CIRCULAR FORMWORK

BACKGROUND OF THE INVENTION

The present invention relates to a device for adapting a formwork element constituted by a formwork lining and at least two formwork beams to a given curvature of a circular formwork, the device comprising a web engaging the space between two formwork beams and a cross-piece fixed to the web and equipped with two parallel, spaced plates which project laterally beyond the web and overlap the formwork beams in the installed position, and whose projecting portions are provided with mounting lugs.

A device of this type has been known, for example in the form of the double-beam yoke marketed by the PERI company. These devices are used in connection with formwork elements for circular formwork which is to be adjusted to a given curvature radius of a concrete wall to be poured. In order to effect such adjustment, the devices are fixed to two formwork beams of the formwork element and interconnected by means of adjusting spindles. Then, the outer ends of the adjacent formwork beams are either moved towards or away from each other by corresponding actuation of the adjusting spindles, whereas the spacing between the lateral faces of the formwork beams, which are fixed to the formwork lining, remain constant at all times so that any operation of the adjusting spindle will cause the formwork element to bend and, consequently, cause the formwork lining to assume a curved surface. Given the fact that the formwork lining consists of a plane plate, the cantilevered ends of the formwork lining show the tendency to maintain their straightness, with the circular formwork element in this bent position, so that they will project tangentially from the outermost formwork beams. If, in the event of a circular formwork, these tangentially projecting contilevered ends were not corrected, the finished concrete wall would exhibit deviations from the desired curvature in the form of edged recesses or edged bulges.

One has, therefore, tried to force the cantilevered ends into the desired position, either by arranging formwork beams at the edge of the cantilevered ends or by providing pressure pieces on the formwork or by using junction ferrules with marginal-beam adjusting means. These correction elements are also fixed on the beforementioned device and adjusted to the correct position, for example with the aid of adjusting spindles.

It is regarded as a drawback of these arrangements that considerable input of material and time is required for correcting the cantilevered ends of the formwork lining. In addition, the device described at the outset is connected with the disadvantage that a limited number only of adjusting spindles can be fixed on the device.

SUMMARY OF THE INVENTION

Now, it is the object of the present invention to provide a device for adapting a formwork element to a given curvature of a circular formwork, which permits easier and quicker handling, requires a lesser number of elements for ensuring correct adjustment of the formwork elements and which is capable of eliminating, in particular, the before-described disadvantages.

According to the present invention, this object is achieved by the fact that a plurality of lugs is provided on at least one projecting portion and that the lugs are arranged in two planes provided at different spacings relative to the web.

This projecting portion of the cross-piece, which is now provided with a plurality of lugs, enables at least one adjusting spindle and/or turnbuckle to be fixed by means of one of the lugs, for adjusting the spacing from the closest cross-piece and, accordingly, the curvature of the formwork element. The other lug serves for receiving the adjusting devices for adjusting the cantilevered ends of the formwork lining. The device according to the invention, therefore, provides the advantage that the elements, for example the adjusting spindles, or the like, serving for adjusting the spacings between adjacent cross-pieces, i.e. for adjusting the curvature of the circular formwork, can be fitted, aligned and adjusted independently of the elements, for example the adjusting spindles or the like, which serve for adjusting the cantilevered ends of the formwork lining. And the elements serving for adjusting the cantilevered ends of the formwork lining can be handled independently of the other devices as well.

Another advantage of the invention is seen in the fact that the mounting lugs are arranged in different planes. This prevents the different adjusting devices from crossing each other at their points of fixation, which would otherwise be unavoidable.

According to a particularly advantageous arrangement, each projecting portion is provided with at least one mounting lug in each of the two planes; more specifically, each projecting portion is provided with two mounting lugs in the plane further remote from the web. This provides the advantage that, when tension and pressure adjusting spindles of different lengths are used, these can be fixed at different points of the cross-piece so that optimum transmission of the forces can be achieved.

According to a preferred embodiment of the invention, the plates are provided with marginal strips bent off at an angle, in particular a right angle. This provides a reinforcement for the plates of the cross-piece and increases their load-carrying capacity.

Preferably, the web is equipped with marginal strips with mounting holes. These mounting holes, which are arranged in particular in the marginal strips, enable the web and, thus, the entire device to be fixed on the formwork beam, for example by screwing. According to a particularly advantageous variant, the mounting holes are arranged in the area of the front and/or rear end of the web. In the case of this embodiment of the invention, the device is fixed on the flanges of the formwork beams so that the tensional and pressure forces can be safely controlled and transmitted.

According to a preferred embodiment of the invention, the plates project laterally beyond the web, for example by the width of one mounting lug. This provides the advantage that in case of need the tensioning and/or pressure device fixed on this projecting portion by means of a mounting lug, in particular an adjusting spindle, can be aligned or adjusted to assume a position parallel to the web of the device to that it can act upon the formwork lining or one of its cantilevered ends at a point directly next to a formwork beam.

According to a particularly advantageous embodiment of the invention, the plane of the web corresponds substantially to the plane of the lower one of the two plates. This arrangement improves the transmission of forces to the formwork beams and makes room for turnbuckles, or the like.

According to a preferred embodiment of the invention, a bearing piece connecting the two plates with each other and with the end of the web facing away from the formwork lining comprises mounting means for fixing the device in position on the formwork beams. This bearing piece, therefore, serves on the one hand for fixing the two parallel plates and, on the other hand, for fixing them on the end of the web facing away from the formwork lining. The additional mounting means serve for fixing the device on both the flanges and the webs of the framework beams. The mounting means used may consist of screws and, on the other hand, of clamping devices.

According to a particularly advantageous arrangement, the bearing piece is provided with a central opening. This opening serves, for example, as passage for tie rods intended for being fastened on the longitudinal sides of the two parallel plates by means of tie plates, nut plates, or the like.

Advantageously, the bearing piece extends only over part of the length of the plates, which increases the flexibility of use of the device.

According to a particularly advantageous arrangement, the cross-piece is designed for asymmetrical absorption of forces, outside its longitudinal center axis. This means that the adjusting spindes may act upon the device outside its longitudinal center axis, i.e. at the upper and lower plates and/or planes, which makes them in addition freely accessible.

Other details, features and advantages of the invention will become apparent from one particularly preferred embodiment of the invention which will be described hereafter in more detail with reference to the drawing.

DESCRIPTION OF THE PREFERRED EMBODIMENTS

Figure 1:
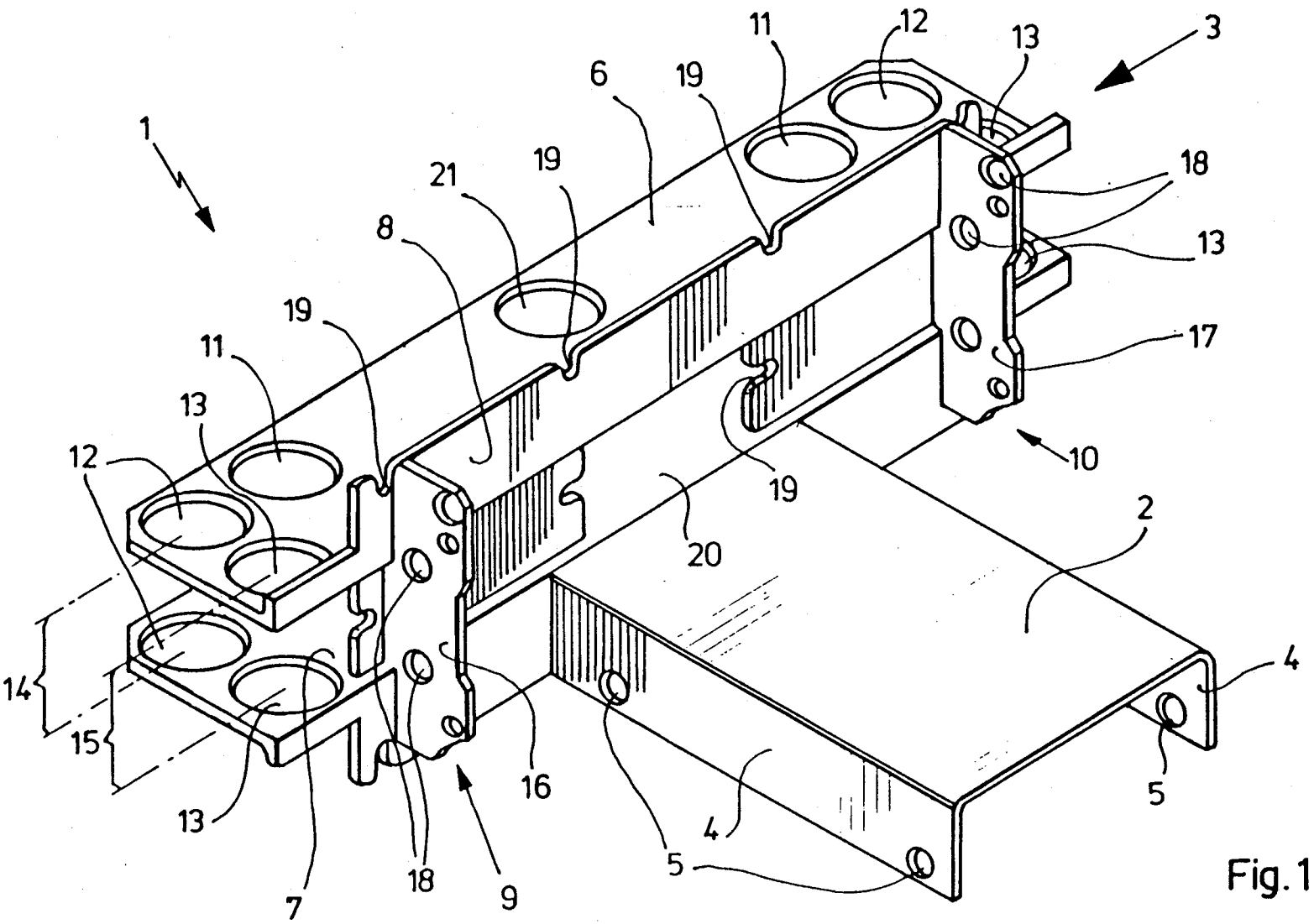
FIG. 1 shows a perspective view of one embodiment of the device according to the invention.

The embodiment of a device for adapting a formwork element to a given curvature of a circular formwork, which is generally indicated by reference numeral 1 in FIG. 1, comprises substantially a web 2 and a cross-piece 3. The web 2 is provided with marginal strips 4 which are bent off laterally, in the embodiment illustrated in FIG. 1 downwardly at a right angle, and which are provided with mounting means 5, for example mounting holes. The mounting means 5 are, preferably, arranged in the area of the two narrow ends of the web 2. The cross-piece 3, which is connected with a narrow end of the web 2, comprises two parallel plates 6 and 7 which are spaced from each other and whose planes extend in parallel to the plane of the web 2. The two plates 6 and 7 are interconnected by a bearing piece 8 which serves to carry the plates 6 and 7 and also to fix them in position relative to the web 2. The plates 6 and 7 are designed in such a manner that they project laterally beyond the web 2, the projecting portions 9 and 10 corresponding substantially to the width of the web. In addition, the projecting portions 9 and 10 are provided with a plurality of mounting lugs 11, 12 and 13 serving for fixing adjusting spindles and other tensioning and pressure devices in position, for the purpose of adjusting the formwork lining. The arrangement of the mounting lugs 11 to 13 in the plates 6 and 7 is such that the mounting lugs 11 and 12 provided in the plates 6 and 7 form a first plane 14, while the mounting lugs 13 in the plates 6 and 7 form a second plane 15, the planes 14 and 15 extending in parallel to each other and, preferably, in parallel to the bearing piece 8 as well. The planes 14 and 15 extend at different spacings from the web 2 and, accordingly, from the formwork lining.

In addition, the bearing piece 8 comprises two parallel legs 16 and 17 spaced from the marginal strips 4 of the web 2 by a distance corresponding to the width of one flange of the formwork beam so that the space between the legs 6 and 7 and the marginal strips 4 of the web 2 can accommodate one formwork beam, as depicted in the following figures. After introduction of the formwork beams, they can be fixed on the device 1 by means of the mounting means 18 of the legs 16 and 17. Additional mounting means 19 are arranged in the bearing piece 8 for alternative of additional use.

Further, the design of the bearing piece 8 is selected in such a manner that the bearing piece extends only over part of the length of the plates 6 and 7 so that the portions 9 and 10 of the plates 6 and 7 are freely accessible from the direction of the web 2. In addition, the bearing piece 8 is provided with a central opening 20 which may be used as passage opening for introducing tie rods, or the like. Given the fact that the plane of the web 2 coincides with the plane of the plate 7, a tie rod, for example, can be passed through the device 1, above the web 2.

Finally, the plates 6 and 7 are provided with an additional central mounting lug 21, arranged preferably in the plane 14 and serving for fixing a tie beam intended to receive and support turnbuckles 38, as depicted in more detail in the following figures.

Figure 2:
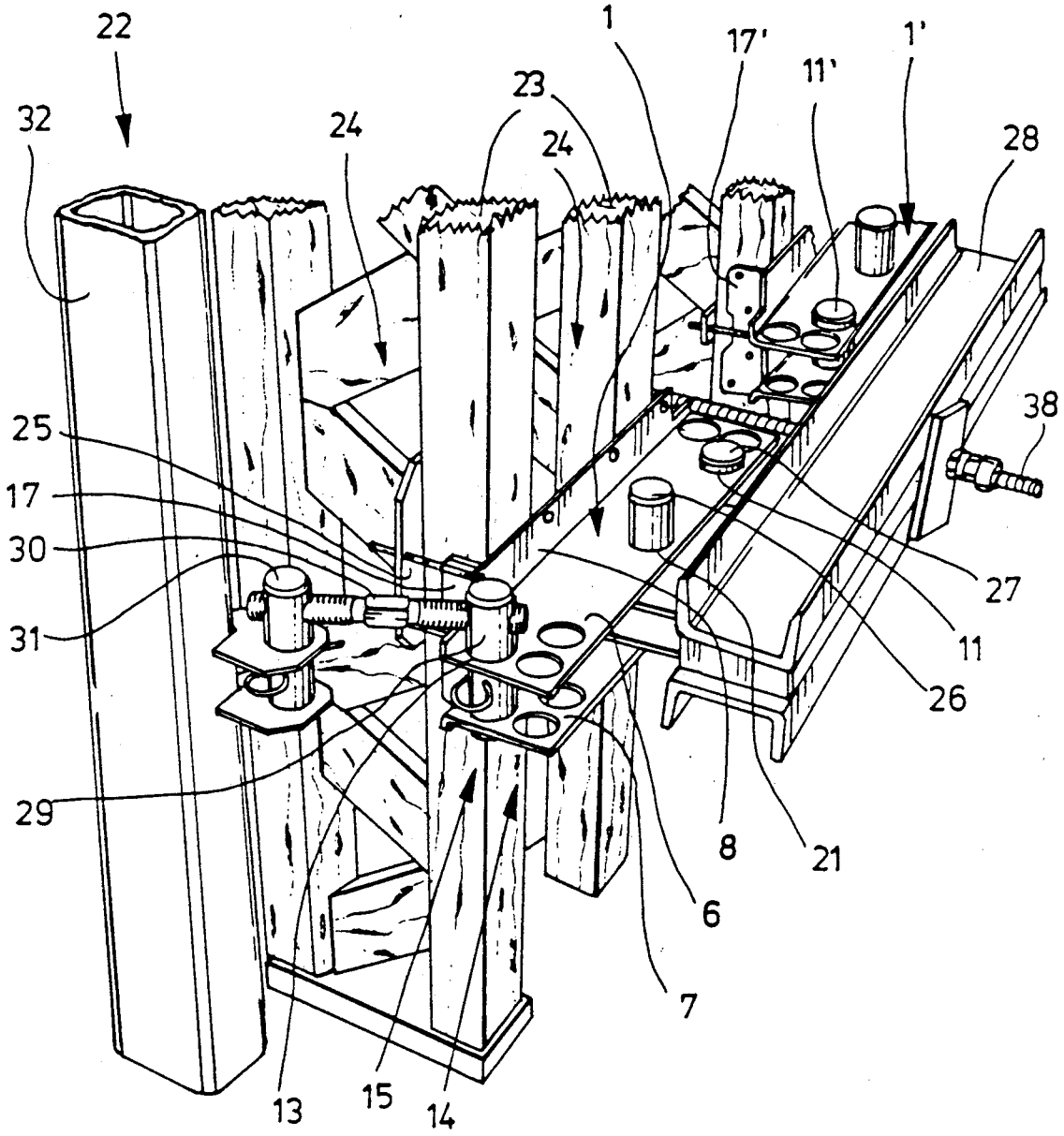
FIG. 2 shows a perspective view of one application of the device according to FIG. 1.

In the case of the application illustrated in FIG. 2, where the device 1 is arranged at the edge of a circular formwork 22, the device 1 is fixed on the flanges 23 of two formwork beams 32, via the bearing piece 8, for example by means of clamping devices 25 engaging the flanges 23 from the rear. The web 2, which is not visible in this illustration, passes in this case between the two formwork beams 24. The legs 16 (not visible) and 17 are in lateral contact with the flanges 23. Two mounting bolts 26 and 27, which are inserted into the lugs 21 and 11 in the plane 14, serve for retaining a tie beam 28 and an adjusting spindle (not visible), the latter being connected, via a mounting bolt 11', to another device 1' arranged next to its side.

A third mounting bolt 29 introduced through the mounting lugs 13 (plane 15) in the plates 6 and 7 is engaged by an adjusting spindle 30 acting upon the cantilevered end 32 of a formwork lining 33 (FIG. 4), via another mounting bolt 31. The adjusting spindle 30, when operated, varies the spacing between the two mounting bolts 29 and 31, thereby adapting the cantilevered end 32 of the formwork lining 33 to the desired curvature of the circular formwork 22.

Figure 3:
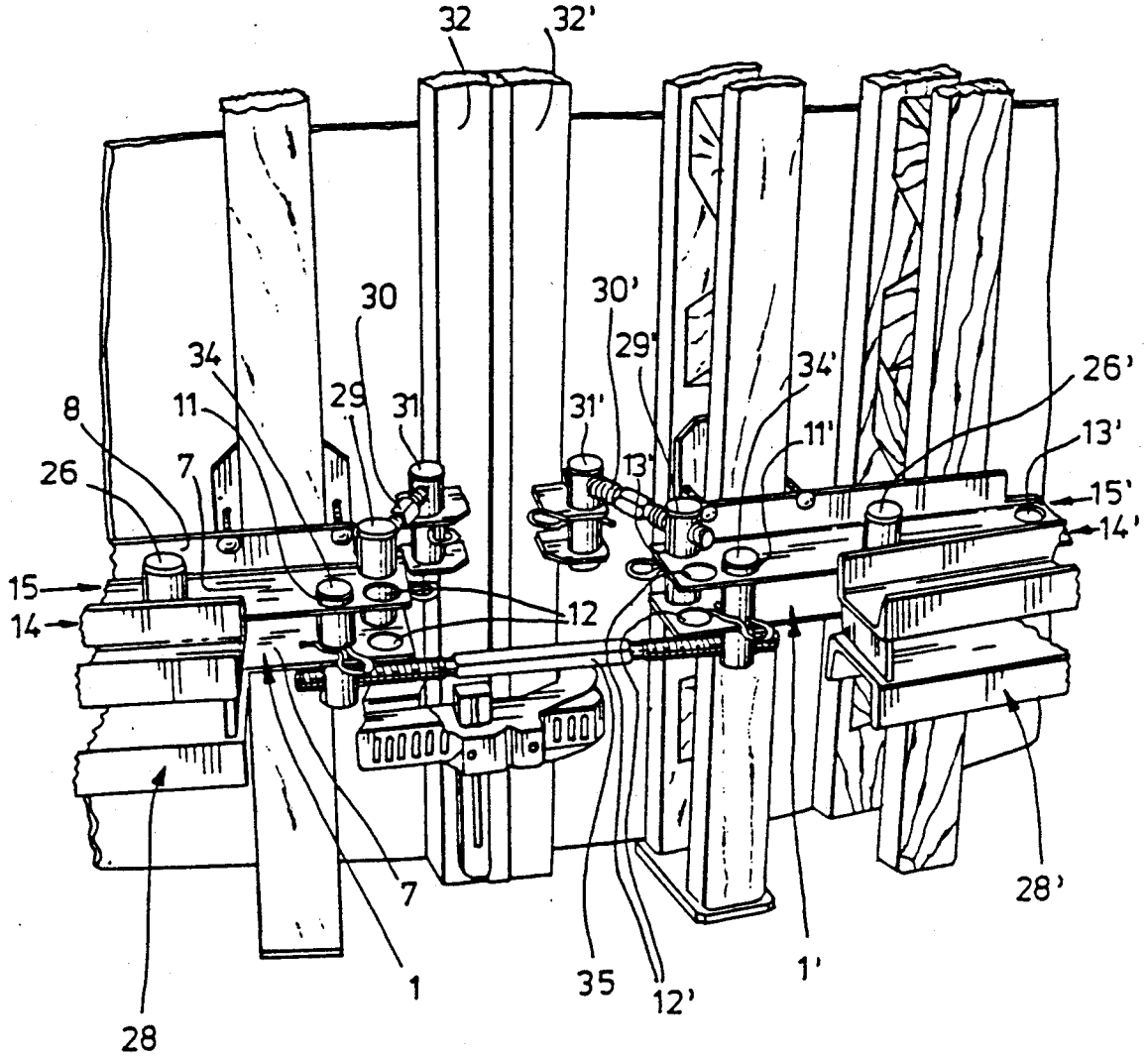
FIG. 3 is a perspective view of another application of the device.

FIG. 3 shows another possible application. In this case, the devices 1 and 1' are arranged on two laterally adjacent formwork elements, similar to the application illustrated in FIG. 2, except that in the case of FIG. 3 additional mounting bolts 34 and 34' have been inserted in the mounting lugs 11 and 11', for engagement by an adjusting spindle 35. By adjusting this adjusting spindle, it is now possible to vary the spacing between the two mounting bolts 34 and 34' and, consequently, the curvature of the circular formwork. Correspondingly, the cantilevered ends 32 and 32' of the formwork elements are adapted to the curvature of the circular formwork by adjusting the adjusting spindles 30 and 30'. It will be seen in the respresentation of FIG. 3 that, due to the mounting lugs 11, 12 and 13 on the one hand and 11', 12' and 13' on the other hand, arranged in the two different planes 14 and 15, the mounting bolts 29, 34 and 29', 34', respectively, of the adjusting spindles 30, 30' and 35 are arranged in such a manner that the adjusting spindles 30, 30' and 35 do not interfere with each other, in particular do not cross each other. In addition, it will be easily recognized that in the extreme case the adjusting spindle 30 or 30' can be arranged to extend substantially in parallel to the web 2, as the bearing piece 8 extends only over part of the length of the plates 6 and 7.

Figure 4:
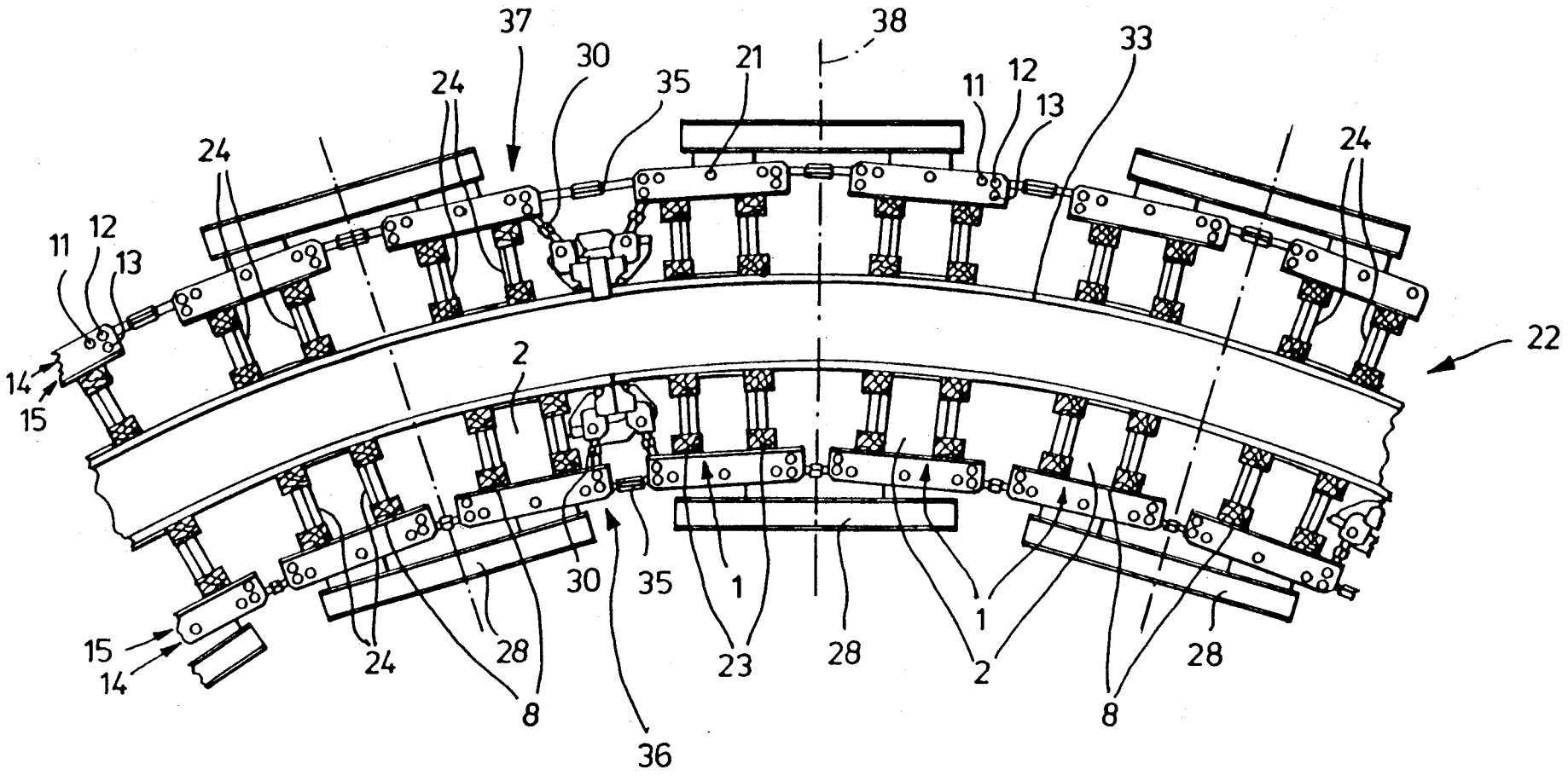
FIG. 4 shows a diagrammatic representation of a formwork element adapted to a given curvature of a circular formwork by means of the devices illustrated in FIG. 1.

In the case of the embodiment illustrated diagrammatically in FIG. 4, a plurality of formwork beams 24 are arranged at equal spacings along the formwork lining 33 of the circular formwork 22, with every pair of formwork beams 24 embracing one device 1 in such a manner that the web 2 of the device 1 is engaged between the two formwork beams 24. The web 2 extends almost over the full depth of the formwork beam 24. The lateral faces of the flanges 23 of the formwork beam 24 facing away from the formwork lining 33 support the bearing piece 8 of the device 1 so as to retain the device 1 safely on the formwork beams 24, by means not separately shown in FIG. 4.

As can be seen at 36 and 37, the different planes 14 and 15 enable the adjusting spindles 30 and 35 to be fixed in position at the different mounting lugs 11, 12 and 13 (FIG. 1), according to the particular requirements, without interfering with each other. In addition, it can be seen at 36 that the adjusting spindle 30 extends almost in parallel to the web 2 of the device 1.

The reference numerals appearing in the claims do not in any way restrict the invention, but are meant only to facilitate its understanding.

I claim:

1. A device for supporting a formwork element having a formwork lining and at least two spaced apart formwork beams attached thereto, the device comprising:

a plurality of webs, each sized for insertion between two formwork beams;

a cross-piece fixed to each web and having two, parallel, spaced apart plates attached thereto, said plates projecting laterally from the web and sized to overlap the formwork beams when the web is inserted between two formwork beams, said plates including a plurality of holes, said holes being arranged in two planes disposed at different spacings related to the web;

mounting bolts each sized for insertion into a hole; and adjusting spindle means for interconnecting mounting bolts inserted into adjacent devices disposed between formwork beams for adjusting the curvature of the formwork lining by movement of formwork beams.

2. A device according to claim 1 wherein each plate is provided with one hole in a plane closer to the web and with two holes in a plane farther from the web.

3. A device according to claim 1 wherein each plate is provided with two holes in a plane farthest from the web.

4. A device according to claim 1 wherein the web is provided with marginal strips bent off at an angle thereto.

5. A device according to claim 4 wherein said marginal strips include mounting holes.

6. A device according to claim 5 wherein said mounting holes are arranged in either or both of an area of a front and a rear end of the web.

7. A device according to claim 6 wherein a plane of the web substantially coincides with a plane of a lower one of the two plates.

8. A device according to claim 1 further comprising a bearing piece connecting the two plates with each other and with an end of the web facing away from the formwork lining when the web is inserted between two formwork beams, said bearing piece comprising mounting means for fixing the device in portion on the formwork beams.

9. A device according to claim 8, wherein said bearing piece includes means, defining a central opening therein, for enabling the introduction of tie rods through the device.

10. A device according to claim 8 wherein the bearing piece extends only over a part of a length of the plates.

* * * * *